United States Patent [19]

Nukaga

[11] 4,340,267

[45] Jul. 20, 1982

[54] SAFETY ELECTRICAL PLUG

[76] Inventor: Tokuji Nukaga, Fukazawa 1 - 2 - 5, Setagaya-ku, Tokyo, Japan

[21] Appl. No.: 159,008

[22] Filed: Jun. 13, 1980

[51] Int. Cl.[3] ..... H01R 13/44

[52] U.S. Cl. ..... 339/42

[58] Field of Search ..... 339/40, 42

[56] References Cited

U.S. PATENT DOCUMENTS 3,575,684 4/1971 McIntyre ..... 339/42

FOREIGN PATENT DOCUMENTS 7310619 2/1975 Netherlands ..... 339/42

1410679 10/1975 United Kingdom ..... 339/42

*Primary Examiner*—Joseph H. McGlynn

*Assistant Examiner*—John S. Brown

*Attorney, Agent, or Firm*—Pearne, Gordon, Sessions, McCoy & Granger

[57] ABSTRACT

A safety electrical plug comprising a casing formed by a pair of identical portions provided with cooperating cord insertion opening forming means, ribs and rib-support means, a spring-loaded blade covering member, a pair of plug blades supported by said rib-support means and extending through the covering member and a spring housing having a spring received therein to normally bias the blade covering member to its extended position.

5 Claims, 4 Drawing Figures

SAFETY ELECTRICAL PLUG

BACKGROUND OF THE INVENTION

This invention relates to a safety electrical plug and, more particularly, to a safety electrical plug which is provided with an automatic blade covering means adapted to prevent the blades from being inadvertently exposed externally to thereby protect the user against possible danger of electric shock.

There have been proposed and practically employed a variety of electrical plugs which are provided with blade covering means. However, the blade covering means in the prior art safety electrical plus are complicated in construction and operation and not applicable to mass production. Furthermore, the conventional blade covering means cannot effectively cover the blades when the blades inadvertently slip out of the receptacle because the conductive members in the receptacle have worn away.

SUMMARY OF THE INVENTION

Thus, one object of the present invention is to provide a safety electrical plug provided with automatic blade covering means which is simpler in construction and operation.

Another object of the present invention is to provide a safety electrical plug provided with automatic blade covering means which is advantageously applicable to mass production.

Another object of the present invention is to provide a safety electrical plug provided with automatic blade covering means which can effectively cover the blades even when the blades inadvertently slip out of the receptacle because the conductive members in the receptacle have worn away.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
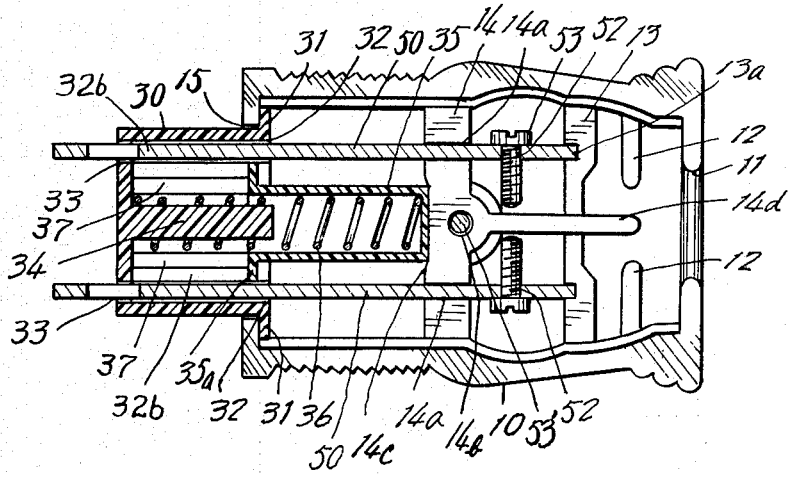
FIG. 1 is a longitudinal horizontal sectional view of one preferred embodiment of the safety electrical plug constructed in accordance with the present invention.
Figure 2:
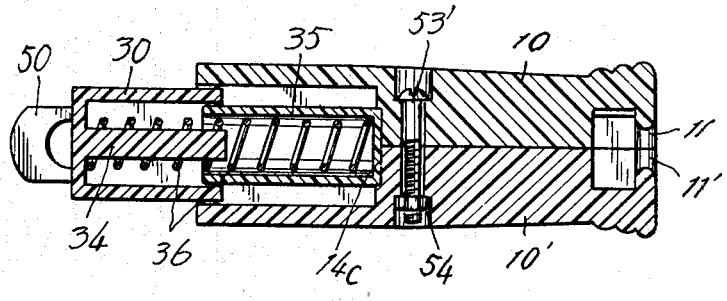
FIG. 2 is a longitudinal vertical sectional view of the safety electrical plug.
Figure 3:
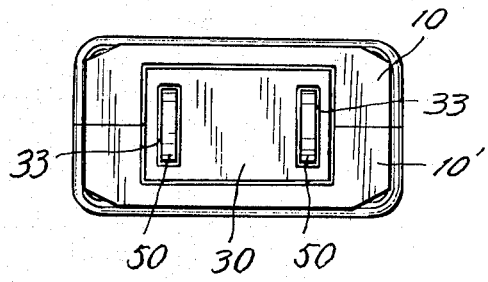
FIG. 3 is an end elevational view of the safety electrical plug.
Figure 4:
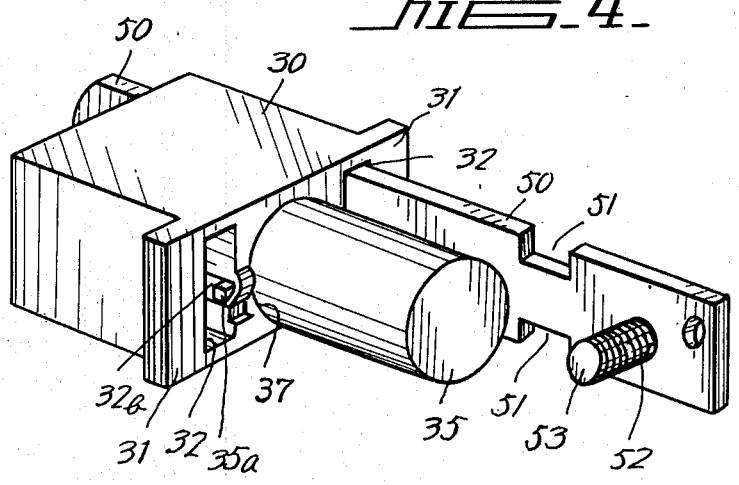
FIG. 4 is a perspective view on an enlarged scale of the internal mechanism of the safety electrical plug.

The present invention will now be described referring to the accompanying drawings in which one preferred embodiment of the safety electrical plug constructed in accordance with the principle of the present invention is shown for illustration purpose only, but not for limiting the scope of the invention in any way.

The safety electrical plug generally comprises a casing which consists of a pair of substantially hollow casing portions 10, 10' molded from synthetic resin. Since the casing portions 10, 10' are identical with each other in construction, the construction of the casing portion 10 will be in detail described with the understanding that the same is equally applicable to the other casing portion 10' the corresponding parts of which are described by the use of the same reference numerals with the addition of a prime thereto, respectively. The casing portion 10 has a recess 11 which is formed in one end wall of the casing portion 10 to form a cord insertion opening in cooperation with a recess 11' in the corresponding end wall of the casing portion 10', a pair of ribs 12, 12 extending inwardly from the inner sides of the opposite side walls of the casing portion 10 and terminating short of the longitudinal axis of the casing portion 10 to leave an opening between the leading ends of the ribs, a first rib-blade support 13 extending between the opposite casing portion side walls in parallel to and spaced inwardly of the ribs 12, 12 and provided with a pair of notches **13*a*, 13*a* on the opposite sides of the longitudinal axis, a second rib-blade support 14 extending between the opposite side walls of the casing portion 10 inwardly of and in parallel to the first rib-blade support 13 and provided with a pair of notches 14*a*, 14*a* aligned with the notches 13*a*, 13*a* and extending the full width of the rib-blade support 14 and an opening 15 formed in the other end wall of the casing portion 10. The second rib-blade support 14 includes a hole 14*b* in the central portion of the width, a recess 14*c* on the side thereof facing the other end wall of the casing portion 10 and an axial extension 14*d* extending beyond the first rib-blade support 13 into the opening defined by the ribs 12, 12. The ribs 12, 12 and first rib-blade support 13 have the same height and the second rib-support 14 has a height greater than that of the ribs 12, 12 and first rib-blade support 13**.

A synthetic resin box-shaped protection member 30 is received in the casing portion 10 between the second rib-blade support 14 and the other end wall of the casing portion 10 and has a pair of extensions 31, 31 extending outwardly in opposite directions from the inner side wall of the protection member 30. The inner side wall of the protection member 30 is provided with a pair of spaced vertically elongated openings 32, 32 and a circular opening 37 positioned between the openings 32, 32. Similarly, the outer side wall of the protection member 30 is provided with a pair of spaced similar vertically elongated openings 33, 33 in alignment with the openings 32, 32 in the inner side wall. A cylindrical spring housing 35 formed of synthetic resin is received in the casing portion 10 between the second rib-blade 14 and the other end wall of the casing portion 10 and opens at the outer end which abuts against the other end wall of the casing portion 10 and is closed at the inner end which is received in the recess **14*c* in the second rib-blade support 14. The protection member 30 further includes a circular projection 34 extending from the inner surface of the outer side wall of the protection member through the circular opening 37 into the spring housing 35. A coiled spring 36 is received within the cylindrical spring housing 35 surrounding the projection 34 with the outer end extending out of the open outer end of the spring housing 35 to abut against the outer side wall of the protection member 30 to thereby normally push a substantial portion of the protection member out of the opening 15 in the other end wall of the casing portion 10. The protection member 30 is prevented from coming off the casing portion 10 under the force of the spring 36 because the oppositely extending extensions 31, 31 abut against the other end wall of the casing protion. The protection member 30 is further provided with a pair of horizontal grooves 32*b* in communication with the circular opening 37 and with the respectively associated vertically elongated openings 32, 32. The spring housing 35 is provided at the open end with a pair of projections 35*a*, 35*a* oppositely and horizontally extending from the open end and the projections are adapted to be received in the respectively associated grooves 32*b*, 32*b* when the protection member 30** is biassed to its fully extended position.

A pair of plug blades 50, 50 extend through the vertically elongated openings 32, 32 and 33, 33 in the opposite side walls of the protection member 30 to be electrically insulated externally by the protection member 30. Each of the plug blades 50, 50 includes in an intermediate position between the opposite ends of the blade a pair of oppositely disposed notches 51, 51 received in the mating notches **14*a*, 14*a*' in the second rib-blade supports 14, 14' of the casing portions 10, 10', respectively and a threaded hole 52 at the inner end for receiving a screw 53' which secures core wires of an electrical cord (not shown) introduced into the casing through the cord insertion opening defined by the recesses 11, 11' in the casing portions 10, 10', respectively. The length of the plug blades 50, 50 is so selected that even when the protection member 30 is biassed to its fully extended position, the leading portions of the blades remain exposed to be inserted into a mating wall receptacle, for example. Finally, the extreme inner end of the plug blade 50 is received in the notch 13*a* or 13*a*' in the first rib 13 or 13' of the casing portion 10 or 10' whereby the plug blade 50 is held in position within the casing. In order to complete the safety electrical plug of the present invention, the other casing portion 10' is applied to the casing portion 10 in which the protection member 30, the spring housing 35 having the spring 36 received, the blades 50, 50 and the electrical cord (not shown) held in position in the manner as mentioned hereinabove so as to align the corresponding components of the two casing portions with each other and a screw 53' is then passed through the holes 14*b*, 14*b*' in the casing portions 10, 10' and screwed into a nut 54** to thereby complete the assembly of the plug.

With the above-mentioned construction and arrangement of the components of the safety electrical plug of the present invention, in use, when the plug is to be electrically connected to a wall receptacle, the exposed end portions of the plug blades 50, 50 are first inserted into the mating holes in the receptacle and the casing 10 is pushed against the receptacle whereby the protection member 30 is retracted into the casing against the force of the spring 36 to expose a substantial portion of the blades 50, 50 which are then electricaly connected to the conductive members in the receptacle. When the conductive members in the receptacle have worn away to the extent that the receptacle cannot positively or firmly hold the plug blades 50, 50 therein or the plug is pulled out of the receptacle, as the blades slip or are pulled out of the receptacle, the protection member 30 extends accordingly out of the casing under the force of the spring 36 whereby the blades are always prevented from being exposed externally to the user so as to eliminate potential electric shock.

As mentioned hereinabove, according to the present invention, since the plug blades 50, 50 are received in and extend through the slidable protection member 30 and the spring housing 35 having the spring 36 received therein is interposed between the protection member 30 and the second rib-blade support 14, in the insertion operation of the safety electrical plug, even when the blades 50, 50 slip out of the receptacle, the protection member 30 automatically extends under the force of the spring 36 to cover the blades to thereby eliminate potential danger. And furthermore, since the spring 36 is received in the insulative spring housing 35 interposed between the protection member 30 and the second rib-blade support 14 is supported on the projection 34 of the protection member 30, the spring 36 is prevented from deflecting or displacing as the protection member 30 extends and retracts and from directly contacting the blades 50, 50 to thereby ensure safe use of the plug without any danger such as short-circuiting.

While only one embodiment of the invention has been shown and described in detail, it will be understood that the same is for illustration purpose only and not to be taken as a definition of the invention, reference being had for this purpose to the appended claims.

What is claimed is:

1. In a safety electrical plug comprising a casing formed by a pair of identical casing portions, each casing portion including cord insertion opening means at one end, a rib, rib-blade support means and second opening means at the other end, a pair of parallel and spaced plug blades supported on said rib-blade support means and extending out of said second opening means, a blade covering member slidably received in said second opening means and receiving said blades, said blade covering member having a pair of vertically elongated openings through which said blades extend, and a spring is interposed between said rib-blade support means and blade covering member to normally bias said blade covering member to the extended position; characterized in that a cylindrical spring housing receives the casing end of said spring and is open at one end to allow said spring to extend into said blade covering member, and has a pair of oppositely extending projections at said open end; and said blade covering member further has a circular opening between said vertically elongated openings for receiving said open end of the spring housing, a pair of horizontal grooves in communication with said circular opening for receiving said projections of the spring housing and a circular projection extending in the axial direction of the covering member to receive said spring on the projection.

2. The safety electrical plug as set forth in claim 1, in which said rib-blade support means comprises a first rib-blade support extending across said casing portion and having a pair of spaced notches for receiving one end of said blades and a second rib-blade support extending across said casing portion inwardly spaced from said first rib-blade support and having a pair of notches in alignment with said pair of notches in the first rib-blade support.

3. The safety electrical plug as set forth in claim 1, in which each of said blades has a pair of oppositely directing notches each to be received in one of said pair of notches in the second rib-blade support of each of said casing portions.

4. The safety electrical plug as set forth in claim 1, wherein said cylindrical spring housing is of electrically insulating material.

5. The safety electrical plug as set forth in claim 1, wherein said pair of horizontal grooves is in communication with said vertically elongated openings.

* * * * *